United States Patent [19]

Wake et al.

[11] Patent Number: 4,999,258

[45] Date of Patent: Mar. 12, 1991

[54] THINLY TIN COATED STEEL SHEETS HAVING EXCELLENT RUST RESISTANCE AND WELDABILITY

[75] Inventors: Ryousuke Wake; Kazuya Ezure, both of Himeji, Japan

[73] Assignee: Nippon Steel Corporation, Tokyo, Japan

[21] Appl. No.: 195,837

[22] Filed: May 19, 1988

[30] Foreign Application Priority Data

May 20, 1987 [JP] Japan ..... 62-122856

[51] Int. Cl.[5] ..... B32B 15/04; B32B 15/18

[52] U.S. Cl. ..... 428/632; 428/648; 428/658; 428/659; 428/679

[58] Field of Search ..... 428/648, 659, 632, 679, 428/666, 658

[56] References Cited

U.S. PATENT DOCUMENTS

| | | | |
|---|---|---|---|
| 3,012,310 | 12/1961 | Goofrey | 428/648 |
| 3,231,127 | 1/1966 | Virzi | 428/648 |
| 3,857,684 | 12/1974 | Kubu | 428/659 |
| 3,997,301 | 12/1976 | Yoshihara et al. | 428/648 |
| 4,143,210 | 3/1979 | Hyner et al. | 428/648 |
| 4,190,504 | 2/1980 | Usui | 428/659 |
| 4,296,181 | 10/1981 | Nehra | 428/648 |
| 4,374,904 | 2/1983 | Harvey | 428/648 |
| 4,490,438 | 12/1984 | Tsuda | 428/659 |

FOREIGN PATENT DOCUMENTS

| | | | |
|---|---|---|---|
| 53-47216 | 12/1978 | Japan . | |
| 57-61829 | 12/1982 | Japan . | |
| 58-117866 | 7/1983 | Japan | 428/659 |
| 58-144496 | 8/1983 | Japan | 428/648 |
| 59-41491 | 3/1984 | Japan | 428/659 |
| 59-30798 | 7/1984 | Japan . | |
| 59-182987 | 10/1984 | Japan | 428/648 |
| 60-50195 | 3/1985 | Japan | 428/659 |
| 60-63394 | 4/1985 | Japan | 428/659 |
| 61-91390 | 5/1986 | Japan | 428/648 |
| 61-139674 | 6/1986 | Japan | 428/648 |

*Primary Examiner*—John J. Zimmerman

*Attorney, Agent, or Firm*—Wenderoth, Lind & Ponack

[57] ABSTRACT

Surface treated steel sheets having excellent rust resistance and weldability, suitable for manufacturing various kinds of cans, produced by a process comprising applying 0.2 to 1 g/m$^2$ of tin coating on a surface of a nickel coated cold rolled steel sheet, applying 0.01 to 0.3 g/m$^2$ of zinc coating on the tin coating in such an amount that the ratio of the zinc coating amount to the tin coating amount is in a range from 2 to 30% by weight, and heating the coatings to alloy substantially all of the zinc into the tin coating layer with substantially no non-alloyed zinc left on the tin coating.

4 Claims, No Drawings

THINLY TIN COATED STEEL SHEETS HAVING EXCELLENT RUST RESISTANCE AND WELDABILITY

BACKGROUND OF THE INVENTION

1. Field of the Invention

The present invention relates to inexpensive surface treated steel sheets having excellent rust resistance and weldability, suitable for manufacturing various kinds of cans. The surface treated steel sheets according to the present invention have excellent rust resistance and satisfactory weldability as surface treated without paint coatings, and hence can provide low-priced sheet material for cans, which can be used in actual service with or without paint coating after can welding.

2. Description of the Related Art

As sheet steel materials for various kinds of cans such as beverage cans, food cans, and aerosol cans, mainly tin-plates and tin-free steel (TFS) have been conventionally utilized, and more recently as sheet steel materials for welded cans, nickel-plated sheets with very thin nickel coating for lowering the production cost as disclosed in Japanese Patent Publication Sho 57-61829, Ni/Sn double layer coated steel sheets as disclosed in Japanese Patent Publication Sho 59-30798 and the like have been developed and actually put into practical use.

However, these conventional sheet materials, particularly tin-plates have disadvantage of high-cost due to the large consumption of high-priced tin, while the tin-free steel, though inexpensive, have the problem that welding cannot be performed without removing the surface film, and the new materials for the welded cans, namely the nickel coated sheets and Ni/Sn double layer coated sheets which have been developed for solving the above problems of the conventional tin-plates and TFS materials have been confronted with the problem of insufficient rust resistance, increasingly pointed out as a real problem in the can industry due to the thin coating which was originally contrived for lowering the production cost.

For these reasons, strong demand has been made by related industries for inexpensive new materials excellent in rust resistance and weldability.

SUMMARY OF THE INVENTION

Therefore, the present invention has as its object to provide new materials for manufacturing various kinds of cans, which can be produced at lower cost, and have excellent weldability and corrosion resistance (a well as rust resistance) as demanded by the related industries by improving the rust resistance of the above mentioned newly developed nickel-plated sheets and Ni/Sn double layer coated sheets and the like.

According to the present invention, an appropriate amount of zinc coating (which has a good rust resistance) is applied on a thinly tin-plated steel sheet, or on a Ni/Sn double layer coated sheet and is alloyed into the tin coating layer to provide a new material having excellent weldability, corrosion resistance, and paintability.

The main feature of the present invention lies in the coating formation process which comprises applying the zinc coating on the tin coating layer and then alloying the zinc coating layer which is detrimental to white zinc rust resistance into the tin coating layer by heating.

Japanese Patent Publication Sho 53-47216 (herein after called prior art) discloses a similar double coating structure composed of a tin coating layer and a zinc coating layer applied thereon. However, this prior art is completely different from the present invention in the following points.

(a) Difference in Technical Object

The present invention aims at improvement of rust resistance and weldability of so-called "super thin tin coated steel sheet" having not more than 1 g/m$^2$ of tin coating on one side of the sheet, whereas the prior art aims at improvement of sulfurization resistance and smudge resistance of ordinary electro-tin-plates. With this difference in the materials to be aimed at, the properties desired by the present invention and the prior art are naturally quite different.

(b) Difference in Inventive Structure and Results

According to the prior art, the heat treatment after the zinc coating is applied on the tin coating is not essential, while in the present invention the most important feature lies, as mentioned above, in that the zinc coating applied on the tin coating is alloyed into the tin coating so that substantially no non-alloyed zinc coating is left thereon. For this purpose, it is essential to limit the ratio of the zinc coating amount to the tin coating amount on which the zinc coating is applied to a specific range and to heat the zinc coating to form Zn-Sn alloy coating layer. If the non-alloyed zinc coating is left on the alloyed coating layer, it produces detrimental effects on the rust resistance and the corrosion resistance after paint coating as will be explained hereinafter.

According to a modification of the present invention, a nickel coating is applied as a sub-treatment before the tin coating. This modification is advantageous in applications where rust resistance and weldability are more important.

DETAILED DESCRIPTION OF THE INVENTION

Conventionally, most of surface treated steel sheet materials for cans are coated with various metal coatings, such as Sn, Ni, and Zn coatings, for the purposes of protecting the steel surface from the ambient atmosphere, or corrosive environments formed by corrosive contents of the cans, or further improving the surface appearance of the cans. In particular, as the materials for food cans and beverage cans, tin-plate and chrome coated steel sheets (TFS) and the like have been mainly used.

In recent years, the art of manufacturing welded cans has been greatly advanced so that the coating amount required for soldering in the soldered can making can be saved and the general tendency is to reduce the coating amount. Thus according to the conventional soldered can making 2.8 g/m$^2$ of tin coating (#25 plating) was required for assuring the solderability, whereas according to the welded can making only 1.15 g/m$^2$ (#10 plating) is sufficient and yet in some cases no tin coating is required and other metal coatings may well be applied so far as they can provide good corrosion resistance.

With the technical limitation being removed in the can manufacturing as above, the tendency has been more promoted toward the minimum coating amount which can satisfy only the corrosion resistance, resulting in the commercial usage of the tin-plates having thin tin coatings (#8 to #20), nickel coated steel sheets and Ni/Sn double layer coated sheets as less costly materials for welded cans.

However, as the above new materials having a thin coating have been more and more widely used, strong demands for improving the rust resistance of these thinly coated new materials have been made from can manufacturers as well as canning and related industries who had long been accustomed to the usage and properties of electro-tin-plates having #25 or higher tin coatings and TFS.

In order to meet the strong demand from these related industries the present inventors have conducted extensive studies and experiments and found how to of substantially improve the rust resistance without increasing the production cost.

One of the most common methods for improving the rust resistance is, as well known, to apply the zinc coating which is very effective to provide sacrificial corrosion protection to the steel sheet. However, with only the zinc coating being applied, white corrosion products of zinc oxide on hydrate compounds are generated to form the so-called white rust which is as detrimental as the red rust to the appearance quality and thus the application of zinc coating alone is not satisfactory for commercial practice, although it can prevent the steel substrate from red rusting.

The present inventors have found that it is possible to obtain a surface treated coating layer which can prevent the formation of the white rust mentioned above and has an enough sacrificial corrosion protection to prevent the red rusting of the steel substrate by alloying the double layers of zinc coating and tin coating into Zn-Sn alloy with substantially no non-alloyed metal zinc being left thereon by heating.

Thus the present invention is to provide a thinly tin-plated steel sheet having excellent rust resistance and weldability which is produced by applying 0.2 to 1 $g/m^2$, preferably 0.6 to 1.0 $g/m^2$, of tin coating directly at least on one side of a cold rolled steel sheet, with or without 0.005 to 0.20 $g/m^2$ of nickel coating previously applied on the substrate, further applying 0.01 to 0.3 $g/m^2$, preferably 0.05 to 0.08 $g/m^2$, of zinc coating on the tin coating so as to maintain the ratio of the zinc coating amount to the tin coating amount in a range from 2 to 30%, preferably 10 to 20%, by weight, and heating the coating until the non-alloyed metal zinc coating layer which is harmful to the corrosion resistance etc., is substantially alloyed.

According to the present invention it is essential that substantially all of the zinc coating applied on the tin coating is alloyed into the underlying tin coating layer and non-alloyed metallic zinc is not left thereon, because the metallic zinc, which is active and has a high corrosion rate, and, if any remains on the coating layer, causes formation of the white rust which is detrimental to the appearance quality of the sheet, but also when a paint coating is applied thereon it seriously deteriorates the under-paint corrosion resistance which is an important property of the can material, because the metallic zinc present under the paint coating is rapidly dissolved by an acidic corrosive liquid.

For these reasons, it is necessary to maintain the ratio of the zinc coating amount to the tin coating amount in the range from 2 to 30% by weight. With 1% or less by weight, the contribution of the zinc coating to the rust resistance etc., is null, while on the other hand, more than 30% by weight, the activity of zinc is promoted and intensified, so that not only the white rust which is the corrosion product of zinc is caused under various corrosive environments, but also in applications where the paint coating is applied, the under-paint corrosion is caused to nullify the effect of the paint coating.

For comparison, the present inventors investigated a reverse process in which the zinc coating is previously applied and the tin coating is applied thereon, and found that the coating structure according to the present invention is superior to the coating structure obtained by the reverse process so far as the improvement of rust resistance is concerned when the tin coating is not more than 1 $g/m^2$ on one side of steel sheet. Hereinbelow, a more detailed description will be made on the reasons for the process for forming the coating structure and for various limitations.

As the steel substrates to be used in the present invention, an ordinary cold rolled steel sheet, or an ordinary cold rolled steel sheet coated with 0.005 to 0.20 $g/m^2$ of Ni on one side (Ni-pretreated sheet) or a nickel-diffused steel sheet obtained by heating the above nickel-pretreated sheet may be selectively used depending on the final uses and objects. Specifically, it is reasonable to use the Ni-pretreated sheet and the Ni-diffused sheet for applications where the rust resistance etc., are particularly required, and the nickel coating amount ranging from 0.005 to 0.20 $g/m^2$ on one side is desired because with less than 0.005 $g/m^2$ of nickel coating, the desired effect of nickel is not obtained, while with more than 0.20 $g/m^2$ of nickel coating, the desired effect saturates, but rather it produces detrimental effects such that it causes pit corrosion of the steel substrate in strong acid solutions, for example.

These substrates are successively coated with 0.2 to 1 $g/m^2$ of tin on one side and then 0.01 to 0.3 $g/m^2$ of zinc on the tin coating so as to maintain the ratio of the zinc coating amount to the tin coating amount in the range from 2 to 30% by weight which is essential for forming the Sn-Zn alloy by the subsequent heating. The zinc coating amount and the tin coating amount are limited to the above specific ranges for the reasons that below their lower limits the rust resistance etc., becomes too low for the practical use, while beyond their upper limits, not only the production cost increases and their improving effects saturate, but also with an excessive zinc coating more than 0.3 $g/m^2$ on one side in particular, there is more tendency that the non-alloyed metallic zinc on the tin coating retained causes the zinc white rust, thus lowering the quality of the cans.

According to the present invention, there is no limitation for the method for forming the zinc and tin coatings and any conventional methods can be used, but the electro-plating method is more convenient and reasonable. And the amounts of the zinc and tin coatings may be different between the front side and the reverse side so far as they are in their specified ranges.

It is also possible according to the present invention that the tin coating is applied on both sides and the zinc coating is applied only on one side, with the other side being without the zinc coating.

According to the present invention, after the double layer coatings of tin and zinc are applied, the coatings are heated to alloy the zinc of the upper coating layer into the tin of the sub-layer so that the Sn-Zn binary alloy layer is formed at least in the surface portion of the resultant coating layer. The heating condition is not specifically limited so far as it enables the alloying of zinc into the coating layer of tin and any conventional heating methods, such as resistance heating, induction heating and gas heating, may be used. Also the heating atmosphere is not specifically limited. However, when the present invention is practiced by utilizing the electro-tin-plate production line, it is reasonable and advantageous to perform the heating treatment at a sheet temperature not less than 240° C. for 0.5 second or longer in the flow-melt step of the electro-tin-plate production line. In this case, the heating temperature should be 240° C. or higher and the time should be 0.5 second or longer for assuring the complete alloying of the zinc into the tin coating layer.

It is not necessary to perform the heating immediately after the zinc coating, but it may be done later simultaneously with the paint coating baking step (usually done at a temperature from 160° to 210° C. for 10 to 60 min.) during the can manufacturing process, for example.

After the heating treatment to alloy the zinc into the tin coating layer, the uppermost surface may further be passivated by a chromate treatment. Inherently, the present invention lies in the coating structure, and not limited to the chromate treatment. However if the chromate treatment is desired, the treatment may be performed by an ordinary method as is applied to ordinary tin-plate and can making materials (Ni coated steel sheets and Ni/Sn double coated steel sheets). Thus the chromate treatment can well be performed by any method commercially practiced for tin-plate and TFS-CT, which is generally effected by a cathodic reduction treatment in a sodium bichromate or chromic anhydride bath free from anions, or in a chromic anhydride bath containing a small amount of sulfate ions. Further, it is needless to say that various techniques known in the art for lowering or removing the co-precipitated anions in the chromate film may be applied.

It is desired that the chromate film contains a total amount of chromium (the structure of the chromate film is very complicated and it is a composite of metallic chromium, chromium oxide, chromium hydroxide etc., and the total amount of chromium represents the total amount of Cr irrespective of the chemical structures) in a range from 3 to 50 mg/m$^2$. Below 3 mg/m$^2$ of Cr, the rust resistance is not satisfactory for practical uses, while beyond 50 mg/m$^2$ satisfactory weldability cannot be assured just as in the case of shortage of the tin coating.

Further, within the scope of the present invention, a known after-treatment, such as a phosphate treatment, so-called bonderising etc., may be applied, though the present invention is not limited thereto.

DETAILED DESCRIPTION OF THE PREFERRED EMBODIMENT

The present invention will be better understood from the following embodiments.

Example 1

0.5 to 1 g/m$^2$ of tin coating was applied by electroplating under the condition shown below (1) on both sides of a steel sheet surface-cleaned by an ordinary method, and then 0.01 to 0.2 g/m$^2$ of zinc coating was applied by electro-plating under the condition shown below (2).

The double layer coating of Sn and Zn was heated by resistant heating under the condition shown below (3) and further a chromate treatment was done under the condition shown below (4) to give a chromate film containing of 10 to 20 mg/m$^2$ of metallic chromium.

(1) Sn Electoro-Plating:

| | |
|---|---|
| Tin Sulfate | 40 g/l |
| Phenolsulfonic Acid | 30 g/l |
| Ethoxy α-Naphthol Sulfonic Acid | 2 g/l |
| Bath Temperature | 40–50° C. |
| Cathode Current Density | 20 A/dm$^2$ |

(2) Zn Electro-Plating:

| | |
|---|---|
| $ZnSO_4 \cdot 7H_2O$ | 200 g/l |
| $Na_2SO_4$ | 100 g/l |
| Bath Temperature | 40–50° C. |
| pH | 2–3 |
| Cathode Current Density | 20 A/dm$^2$ |

(3) Heating:

| | |
|---|---|
| Heating Temperature | 250–280° C. (max.) |
| Heating Time | 2–5 seconds |
| Atmosphere | Air |

(4) Chromate Treatment:

| | |
|---|---|
| $CrO_3$ | 20–100 g/l |
| $H_2SO_4$ | 0.1–1 g/l |
| $Na_2SiF_6$ | 0–3 g/l |
| Bath Temperature | 40–50° C. |
| Cathode Current Density | 5–90 A/dm$^2$ |

Example 2

This example is same as Example 1 except that on both sides of the same steel sheet as used in Example 1, 10 to 20 mg/m$^2$ of nickel coating was applied as a pretreatment under the condition shown below (5).

(5) Nickel Electro-Plating:

| | |
|---|---|
| $NiSO_4 \cdot 7H_2O$ | 200 g/l |
| $NiCl_2 \cdot 6H_2O$ | 50 g/l |
| $H_3BO$ | 40 g/l |
| Bath Temperature | 40–50° C. |
| pH | 2–4 |
| Cathode Current Density | 20 A/dm$^2$ |

Example 3

This example is same as Example 1 except that 60 to 80 mg/m$^2$ of nickel coating was applied under the condition (5) and further nickel diffusion treatment was applied under the condition shown below (6) to form a nickel diffusion layer on both sides of the steel sheet.

(6) Nickel Diffusion Heat Treatment:

| | |
|---|---|
| Heating (gas heating in annealing step of cold rolled strip) | |
| Heating Temperature | 650–700° C. |
| Heating Time | 20–30 seconds |
| Atmosphere | 5% $H_2$–95% $N_2$ |

Example 4

This example is same as Example 1 except that the tin coating was applied under the condition shown below (7).

(7) Electro-Tin-Plating:

| | | |
|---|---|---|
| Stannous Chloride | 75 g/l | |
| Sodium Fluoride | 25 g/l | |
| Potassium Bifluoride | 50 g/l | |
| Sodium Chloride | 45 g/l | |
| Bath Temperature | 40–50° C. | |
| Cathode Current Density | 40–50 A/dm$^2$ | |

Example 5

This example is same as Example 1 except that the zinc coating was applied only on one side of the steel sheet.

Comparison 1

This comparison is same as Example 1 except that no zinc coating was applied on both sides of the sheet.

Comparison 2

This comparison is same as Example 1 except that the heating treatment after the zinc coating was omitted.

Conventional Example 1

An electro-tin-plate (#25 tin-plate) having tin coating of 2.8 g/m$^2$ on one side of the sheet and a chromate film of 8 mg/m$^2$ as metallic Cr.

Conventional Example 2

An electro-zinc coated sheet (EG 20) having a zinc coating of 20.5 g/m$^2$ and a chromate film of 65 mg/m$^2$ as metallic Cr.

The above examples, comparisons, and conventional examples were tested for evaluating their properties according to the evaluation tests (A) to (B) as shown below, and the results are shown in the table.

(A) Salt Spray Test

In order to investigate the rust resistance (non-lacquered), the sample sheets were directly and after 5 mm stretching by an Erichsen testing machine were subjected to salt spray tests with a 5% common salt solution at 35° C. for 72 hours. The results were evaluated by observing the rust formation by eye. The criteria for evaluation are as below.

⊙ : No red rust and no white rust observed.

○ : Very little red rust or little white rust observed.

Δ: Little red rust or some large white rust observed.

X: Red rust under generation observed or considerable white rust observed.

※: Considerable red rust observed.

(B) Seam Welding Test

The sample sheets were formed into the same cylindrical form and subjected to the seam welding tests by using a canning seam welder under the condition shown below by changing the welding secondary current.

| | |
|---|---|
| Lap width of the joint portion | 20 mm |
| Pressure added | 45 kgt |
| Canning speed | 30 mpm |

Their evaluation was done from the range of current appropriate for the welding, the appearance and strength of the welded portions all together. And the evaluation criteria are shown below.

⊙ : Good weldability

○ : Practically good weldability

Δ: Practically unsatisfactory weldability

X: Unweldable (C) Under-Paint-Coating Corrosion Resistance Test

Sample sheets were coated with 60 mg/dm$^2$ (dry weight) of canning epoxyphenol paint by roll-coating, and baked at 205° C. for 10 minutes and further baked at 190° C. for 10 minutes. Then after the paint coatings were cut by a knife, sample sheets were immersed in a corrosive solution of 15 g/l citric acid-15 g/l NaCl (pH: 2.3) at a constant temperature of 50° C. for 96 hours. The coating film peeling-off tests and corrosion tests such as pit corrosion tests were carried out by the taping method and observed by eye and an optical microscope. The evaluation criteria are as below.

⊙ : Very excellent

○ : Good

Δ: Slightly bad

X: Bad

As understood from the results shown in the table, the coated sheets within the scope of the present invention show excellent rust resistance under the non-lacquered condition and weldability, while the sheet materials outside the scope of the present invention, namely the comparisons and conventional examples show inferiority in one of the properties.

The coated sheets according to the present invention, despite of their very thin coating, show excellent rust resistance, weldability and under-film corrosion resistance in well balance as compared with the conventional tin-plate and electro-zinc coated plates or sheets. Therefore the present invention has great industrial advantages in that an excellent material for can stock can be provided at lower production cost and where the heating treatment can be done by utilizing the flow-melt step in the electro-tin-plate production process, the present invention is more advantageous in that the desired sheet materials can be produced reasonably and efficiently without no substantial capital investments. These will greatly contribute to the advantages of manufacturers of surface treated sheet materials for canning as well as their users.

TABLE 1

| Sample | Amount of Sn and Zn Coatings (g/m$^2$) Sn | Zn | Zn/Sn Weight Ratio (%) | Remaining Zn Amount (g/m$^2$) | (A) Salt Spray Test | (B) Seam Welding Test | (C) Under-Paint-Coating Corrosing Resistance Test | Remarks |
|---|---|---|---|---|---|---|---|---|
| Example 1 | 0.80 | 0.10 | 12.5 | 0 | ⊙ | ⊙ | ○ | |
| | 0.50 | 0.08 | 16.0 | 0 | ⊙ | ○ | ○ | |
| | 1.00 | 0.25 | 25.0 | 0 | ⊙ | ⊙ | ○ ~ Δ | |
| | 0.90 | 0.40 | 44.4 | 0.12 | ○ white rust | Δ | X | Beyond the upper limit of ZN amount |
| | 1.00 | 0.01 | 1.0 | 0 | X | ○ | ○ | Below the lower limit of Zn/Sn weight ratio |
| Example 2 | 0.85 | 0.07 | 8.2 | 0 | ⊙ | ⊙ | ⊙ | |
| Example 3 | 0.90 | 0.09 | 10.0 | 0 | ⊙ | ⊙ | ⊙ | |
| Example 4 | 1.00 | 0.12 | 12.0 | 0 | ⊙ | ⊙ | ⊙ | |

TABLE 1-continued

| Sample | Amount of Sn and Zn Coatings ($g/m^2$) Sn | Zn | Zn/Sn Weight Ratio (%) | Remaining Zn Amount ($g/m^2$) | (A) Salt Spray Test | (B) Seam Welding Test | (C) Under-Paint-Coating Corrosing Resistance Test | Remarks |
|---|---|---|---|---|---|---|---|---|
| Example 5 | 0.92 | 0.10 | 10.9 | 0 | ◎ | ◎ | — | Evaluation of Zn coating (B) |
| Comparison 1 | 0.80 | — | — | — | X | ○ | Δ | Zn coating omitted |
| Comparison 2 | 1.00 | 0.25 | 25.0 | 0.25 | X | ○ | X | Heating treatment omitted |
| Conventional Example 1 | | #25 Tin-Plate | | — | Δ | ◎ | ○ | |
| Conventional Example 2 | | EG 20 | | — | Δ | Δ | X | |

* indicates items outside the scope of the present invention.

What is claimed is:

1. A steel sheet having at least on one side thereof a thin tin coating alloyed with zinc, excellent in rust resistance and weldability, produced by a process which comprises applying 0.2 to 1 $g/m^2$ of tin coating on a surface of a nickel coated cold rolled steel sheet, applying 0.01 to 0.3 $g/m^2$ of zinc coating on the tin coating in such an amount that the ratio of the zinc coating amount to the tin coating amount is in a range from 2 to 30% by weight, and heating the coatings to alloy substantially all of the zinc into the tin coating layer with substantially no non-alloyed zinc left on the tin coating.

2. The steel sheet according to claim 1, wherein the nickel coating is present at 0.005 to 0.20 $g/m^2$.

3. The steel sheet according to claim 1, which further has a chromate film on the tin coating.

4. The steel sheet according to claim 1 wherein the nickel, zinc and tin layers are applied by electroplating.

* * * * *